US008304998B2

(12) United States Patent
Taekema et al.

(10) Patent No.: US 8,304,998 B2
(45) Date of Patent: Nov. 6, 2012

(54) DIMMABLE LIGHT GENERATING DEVICE

(75) Inventors: Harko Jan Taekema, Drachten (NL); Jacob Dijkstra, Drachten (NL); Pawel Leshem, Biedermannsdorf (AT); Johannes Albert Frankena, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 326 days.

(21) Appl. No.: 12/746,943

(22) PCT Filed: Dec. 8, 2008

(86) PCT No.: PCT/IB2008/055134

§ 371 (c)(1),
(2), (4) Date: Jun. 9, 2010

(87) PCT Pub. No.: WO2009/077911

PCT Pub. Date: Jun. 25, 2009

(65) Prior Publication Data

US 2010/0253232 A1 Oct. 7, 2010

(30) Foreign Application Priority Data

Dec. 14, 2007 (EP) ..... 07123192

(51) Int. Cl.
*H05B 41/36* (2006.01)
*H01J 61/06* (2006.01)

(52) U.S. Cl. ..... 315/171; 315/DIG. 4; 315/291; 315/160; 313/607

(58) Field of Classification Search ..... 315/160, 315/171, 172, 209 R, 246, 291, DIG. 4; 313/607
See application file for complete search history.

(56) References Cited

U.S. PATENT DOCUMENTS

| | | | | |
|---|---|---|---|---|
| 2,864,035 | A | 12/1958 | Davis | |
| 4,931,696 | A * | 6/1990 | Brower | 315/61 |
| 5,055,738 | A * | 10/1991 | Yorifuji et al. | 313/490 |
| 5,300,860 | A * | 4/1994 | Godyak et al. | 315/39 |
| 5,821,699 | A | 10/1998 | Moisin | |
| 6,367,947 | B1 | 4/2002 | Itaya et al. | |
| 6,727,664 | B2 * | 4/2004 | Miller et al. | 315/224 |
| 6,812,645 | B2 * | 11/2004 | Baarman | 315/56 |
| 7,173,254 | B2 * | 2/2007 | Sauska et al. | 250/455.11 |
| 2002/0101164 | A1 * | 8/2002 | Yan | 315/58 |

FOREIGN PATENT DOCUMENTS

| | | | |
|---|---|---|---|
| EP | 0186244 | A1 | 7/1986 |
| JP | 58112237 | A | 7/1983 |
| JP | 11111218 | A | 4/1999 |
| JP | 2003346551 | A | 12/2003 |
| WO | 8804471 | A1 | 6/1988 |
| WO | 2007046002 | A2 | 4/2007 |

* cited by examiner

*Primary Examiner* — Don Le

(57) ABSTRACT

A compact gas discharge lamp (301) comprising four (or more) interconnected tube segments (11, 12, 13, 14) is provided with an external electrode (310) that extends at least throughout the length of the tube segments and that is in contact with all tube segments. Several embodiments of the external electrode are disclosed. The external electrode is preferably connected to a node (C) midway between the lamp electrodes, to which end a capacitive divider (441, 442) is arranged in parallel with the lamp.

21 Claims, 9 Drawing Sheets

DIMMABLE LIGHT GENERATING DEVICE

FIELD OF THE INVENTION

The present invention relates in general to the field of fluorescent lamps, more particularly a dimmable light generating device comprising a fluorescent lamp.

BACKGROUND OF THE INVENTION

There is a general tendency to replace the traditional incandescent lamps by other types of light sources, such as LEDs and gas discharge lamps. LEDs and gas discharge lamps have, with respect to each other, some advantages and disadvantages, and a designer may choose to use either an LED or a gas discharge lamp, depending on his design considerations.

A light source, be it an incandescent lamp, an LED or a gas discharge lamp, is designed for nominal operation at a nominal lamp voltage and a nominal lamp current, resulting in a nominal lamp power and a nominal light output. If, in a certain situation, a user wishes to have more light, he may replace the current lamp by a more powerful lamp, or by a lamp of a different type having a higher light output. Conversely, if a user wishes to have less light, he may replace a lamp by another lamp having a lower light output. However, this is very cumbersome, so there is a general desire to be able to dim a lamp, i.e. to drive a lamp with a power below its nominal power such that the light output is less than the nominal light output.

The present invention relates particularly to the field of driving a gas discharge lamp at reduced power, i.e. in a dimmed state.

A gas discharge lamp has a negative resistance characteristic, and therefore a ballast device is needed for driving the lamp. Although, in principle, it is possible to drive a gas discharge lamp with DC current, an electronic ballast typically provides a high frequency alternating current. Dimming can for instance be achieved by reducing the magnitude of the lamp current, or by switching the lamp on and off at a certain duty cycle.

Several problems and disadvantages are associated with the different mechanisms for dimming a gas discharge lamp, depending among others on the specific use, especially if it is desirable that the lamp is dimmed to a very low level of less than 1% of the nominal light output. A particular light generating device to which the present invention relates is a so-called wake-up light, which is a device which, triggered for instance by a clock, gradually increases its light output from zero to maximum. One of the problems for such an application is associated with ignition. For its ignition, a gas discharge lamp requires a relatively high voltage. As a result, if the lamp is to be ignited in the dimmed condition with a light output close to zero, the lamp may produce a light flash on ignition and then reduce its light output to the desired dim level. Such a light flash is undesirable.

A further problem is that it is very difficult to maintain lamp stability at a very low dim level.

In the case of gas discharge lamps having filament electrodes, the electrodes need to be supplied by an electrode heating current in order to keep the electrodes at an optimum operative temperature. However, in typical electronic ballasts, the filaments are only heated in the ignition phase, and during dimming the temperature of the filaments may become too low. Thus, it may be necessary to provide a separate electrode heating circuit, but such circuits tend to be complex and relatively expensive.

In a linear gas discharge lamp, the electrodes are arranged at opposite ends of a longitudinal lamp tube. The traditional TL lamp is an example of such a linear lamp. A disadvantage of such a lamp is that the lamp sockets for receiving the lamp terminals in a luminaire must be arranged at a relatively large distance from each other. As an alternative, so-called compact gas discharge lamps have been developed, where the lamp tube can be considered as being folded so that the lamp comprises an even number of tube segments arranged parallel next to each other, while the lamp ends with the lamp electrodes are located next to each other at the same longitudinal end of the lamp. Such a lamp can easily be mounted on a lamp base having a screw cap for screwing the lamp into a standard screw fitting, for instance in order to replace traditional incandescent lamps. In such a lamp type, in the case of application as a wake-up light with very low dim levels, an instability problem may occur in that the lamp, during the first stage of the wake-up sequence, will only emit light from lamp portions close to the electrodes, which portions relatively slowly grow away from the electrodes towards the other end of the lamp, while the intermediate tube segments do not emit light.

The present invention specifically aims to provide a solution to this problem.

SUMMARY OF THE INVENTION

To this end, a compact lamp according to the present invention is provided with an auxiliary electrode, which auxiliary electrode is arranged outside the tube segments, is capacitively coupled to all tube segments, and possibly contacts all tube segments, and said auxiliary electrode being coupled to a reference voltage level.

Further advantageous elaborations are mentioned in the dependent claims.

It is noted that U.S. Pat. No. 2,864,035 discloses the use of an external electrode for a linear gas discharge lamp. This document however gives no suggestion as to how an external electrode should be designed in the case of a compact gas discharge lamp.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
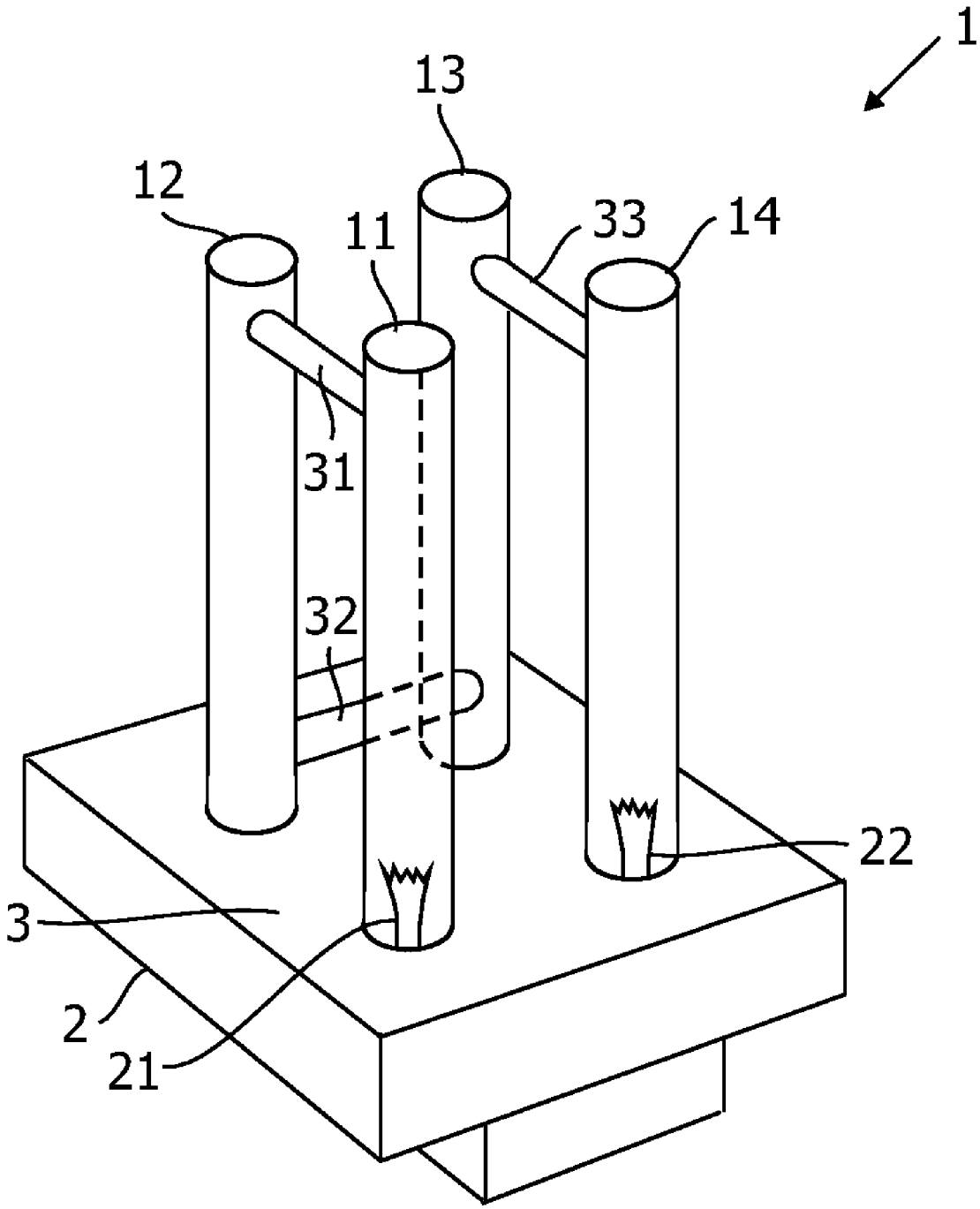
FIG. 1 schematically shows a perspective view of a compact gas discharge lamp.

FIG. 1 schematically shows a perspective view of a compact gas discharge lamp, generally indicated by reference numeral 1. The lamp 1 comprises a lamp base 2, and four tube segments 11, 12, 13, 14 arranged parallel to each other. In the figure, the axial direction of the tubes is directed vertically; this direction will also be indicated as the longitudinal direction. The tubes extend vertically upwards from an upper surface 3 of the lamp base 2. Each lamp segment has two ends, i.e. a proximal end close to the lamp base 2 and a distal end at a distance from the lamp base 2. A first lamp electrode filament 21 is located at the proximal end of the first lamp segment 11. The first and second lamp segments 11, 12 are interconnected by a first bridge segment 31 close to their distal ends. The second and third tube segments 12, 13 are interconnected by a second bridge segment 32 close to their proximal ends. The third and fourth tube segments 13 and 14 are interconnected by a third bridge segment 33 close to their distal ends. A second electrode filament 22 is arranged at the proximal end of the fourth tube segment 14. Each electrode filament is provided with two electrode terminals extending through the base 2 downwards, and each being coupled to a corresponding connector extending from the underside of the lamp base 2, which for the sake of simplicity is not shown in FIG. 1.

A lamp as described above is generally known. An example of such a lamp is a PL-C lamp, commercially available from Philips. Therefore, a further explanation of this lamp design is not needed here.

Figure 2:
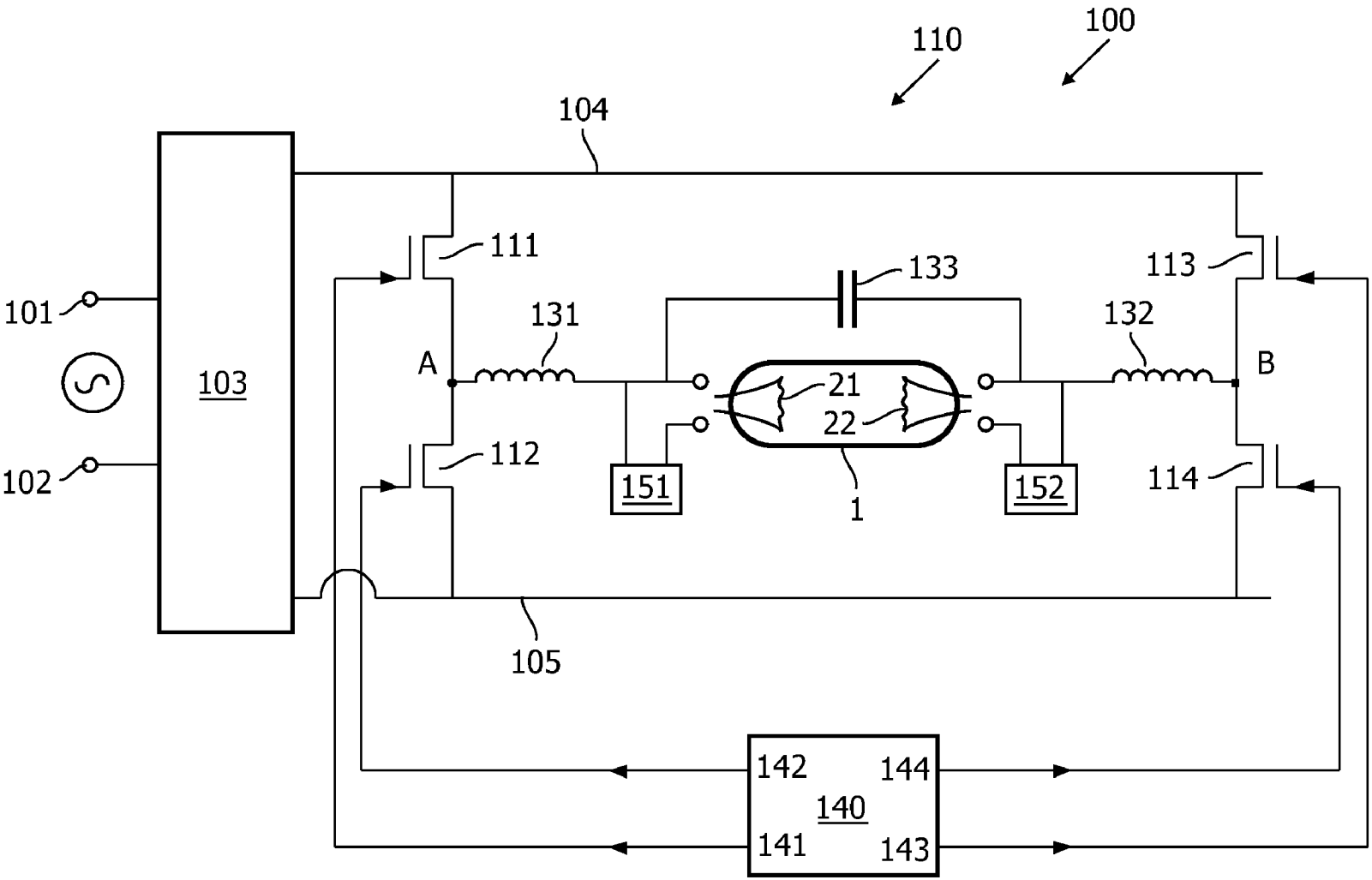
FIG. 2 is a block diagram schematically illustrating an electronic driver.

FIG. 2 is a block diagram schematically illustrating some features of an electronic driver 100 for driving the lamp 1. Although it is possible to supply the driver 100 with DC power, the driver 100 of this example is designed for being powered from the mains, and has two input terminals 101, 102 for receiving a mains voltage, typically 230 Volt at 50 Hz in Europe. In a converter stage 103, the AC input voltage is rectified and converted to a suitable DC power, provided at power lines 104, 105. The driver 100 further comprises a switching bridge 110 comprising a first set of two controllable switches 111, 112 arranged in series between said two power lines 104, 105 and a second series arrangement of two switches 113, 114 arranged in series between said two power lines 104, 105. The driver 100 has two output terminals 121, 123 for connection to the first electrode filament 21 of the lamp 1, and two output terminals 122, 124 for connection to the second electrode filament 22 of the lamp 1. A first inductor 131 is connected between a first output terminal 121 and a node A between said first switches 111, 112. A second inductor 132 is connected between a second output terminal 122 and a node B between the second switches 113, 114. A capacitor 133 is connected between the first output terminal 121 and the second output terminal 122. A controller 140 has control outputs 141, 142, 143, 144 connected to control terminals of the corresponding switches 111, 112, 113, 114. A first electrode heating device 151 has output terminals connected to output terminals 121 and 123 of the driver, while a second electrode heating device 152 has output terminals connected to the output terminals 122 and 124 of the driver 100. These heating devices provide heating current to the electrode filaments 21, 22, respectively, as will be clear to a person skilled in the art.

The controller 140 generates control signals for the first two controllable switches 111, 112 such that either one switch 111 is open (non conductive) while the other switch 112 is closed (conductive) or vice versa. These switches are opened/closed at substantially the same moment, with a slight delay in order to prevent that these switches are both closed at the same moment. Both switches are operated at a duty cycle of 50%, so that they are open just as long as they are closed. The switching frequency, hereinafter indicated as bridge switching frequency, may by way of example be in the order of 100 kHz.

The controller 140 generates control signals for the second set of two controllable switches 113, 114 in a similar manner. The switching frequency for this second set of switches is exactly the same as for the first set of switches. As an operating parameter, the controller 90 can vary the phase difference $\Delta\phi$ between the two sets of switches. If the two sets are operated exactly in phase ($\Delta\phi=0°$), nodes A and B will always have mutually the same potential, so there will be no current flowing in the lamp 1. If the two sets are operated exactly out of phase ($\Delta\phi=180°$), nodes A and B will be at opposite supply line voltage potentials, and an alternating lamp current I having the switching frequency will flow in the lamp 1. Inductors 131 and 132 and capacitor 133 operate as a resonant circuit, and the amplitude of the lamp current depends on the switching frequency.

For operating at a reduced light output level, the controller 140 operates in a duty cycle mode, wherein the lamp current is generated in bursts of alternating current separated by current-free periods. The repetition frequency is lower than the switching frequency; typically, the repetition frequency may for instance be in the order of about 100 Hz.

Dimming can be achieved by changing the switching frequency and/or by changing the duty cycle of the current bursts.

The lamp can be operated at fairly moderate dimming levels. In such a case, the lamp is ignited in normal operating conditions. However, there are situations where it is desirable that the lamp is operated at extremely low dimming levels. This is especially true in the case of wake-up lamps, in which case the lamp has to be started at a light output level close to zero. Then, a problem is that a situation may occur that light is only generated in a proximal portion of the first tube segment 11 and a proximal portion of the fourth tube segment 14, close to the respective electrode 21 and 22. This is believed to be caused by the fact that the operating conditions are insufficient to cause a proper discharge, and a capacitive current is flowing via the glass envelope of the tube segments. Slowly, these light generating portions grow towards the distal ends of the first and fourth tube segments 11, 14, and then the second and third tube segments 12, 13 may start to generate light, but it is also possible that the second and third tube segments 12, 13 do not contribute to the light output at all. All in all, the lamp may show erratic and unstable behavior.

Figure 3:
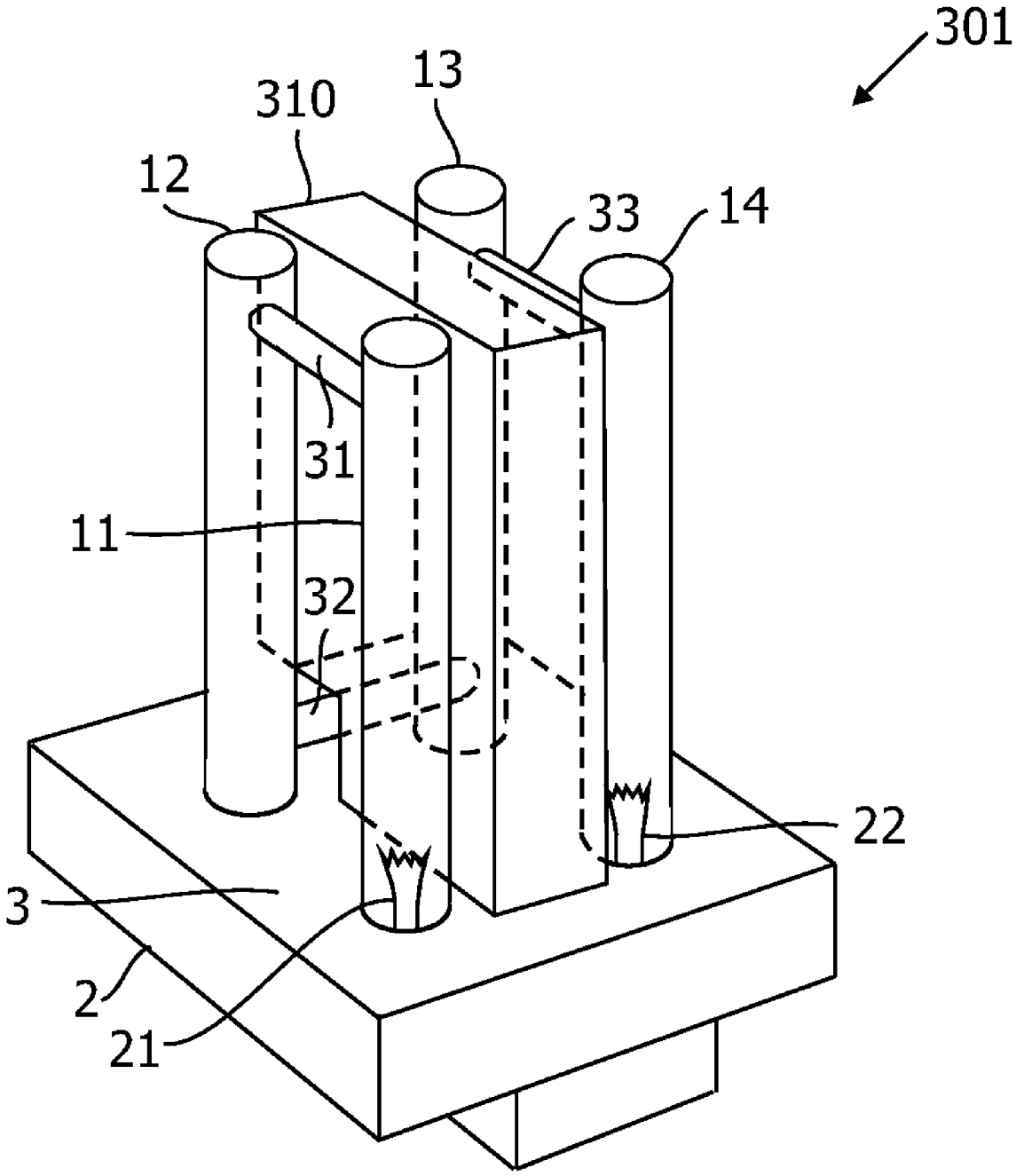
FIG. 3 schematically shows a perspective view of a compact gas discharge lamp provided with an external electrode according to the present invention.

FIG. 3 is a schematic perspective view, comparable to FIG. 1, of a lamp according to the present invention. This lamp, indicated by reference numeral 301, is provided with an external auxiliary electrode 310, placed externally of the tube segments 11, 12, 13, 14. The auxiliary electrode is electrically conductive, has an axial extent corresponding to the axial length of the tube segments, and acts as a capacitive coupling, coupling the four tube segments 11, 12, 13, 14 to each other, thus facilitating a gas discharge to be generated over the entire length of all tube segments. The capacitive coupling is optimal if the auxiliary electrode is in mechanical contact with all tube segments 11, 12, 13, 14.

Figure 4:
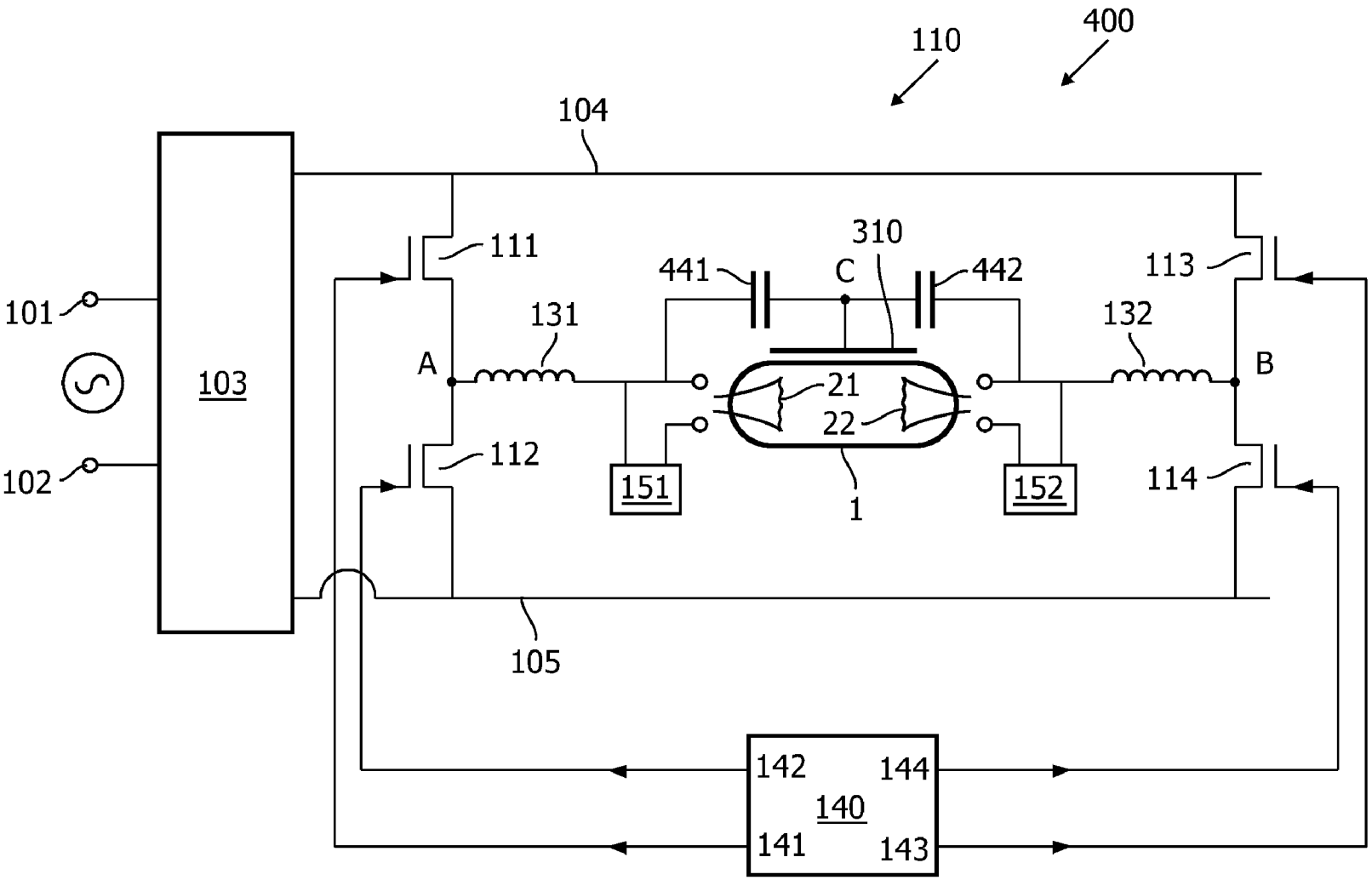
FIG. 4 is a schematic block diagram of an electronic driver.

The auxiliary electrode 310 may be electrically floating, i.e. not electrically connected to any member of the electronic driver. However, an improved effect is obtained if the auxiliary electrode 310 is connected to a reference voltage. Suitable sources for such a reference voltage are ground, or one of the lamp electrodes. In a preferred embodiment, the auxiliary electrode 310 is connected to a voltage midway between the lamp electrode potentials. FIG. 4 is a schematic block diagram of an electronic driver 400 according to the present invention, in which this preferred voltage is implemented. The single capacitor 133 of the driver 100 is replaced by a series arrangement of two capacitors 441 and 442, which may be of different capacitance value but which preferably are identical. Auxiliary electrode 310 is connected to a node C between said two capacitors 441 and 442.

Figure 5A:
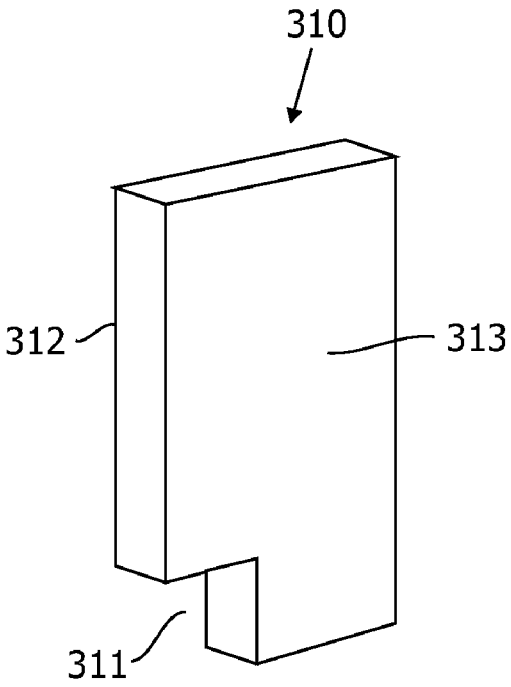
FIGS. 5A-5F illustrate several shapes of an external electrode according to the present invention.
Figure 5B:
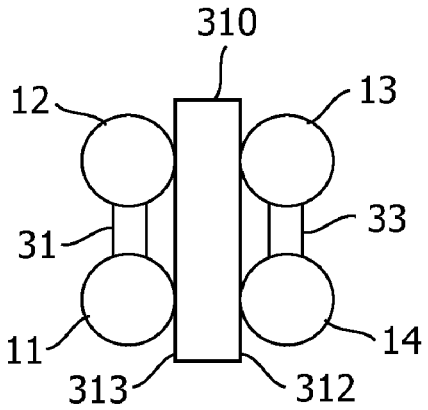

There are several possible shapes for the auxiliary electrode 310. FIG. 5A is a schematic perspective view of a first possible embodiment of the auxiliary electrode 310, in which the auxiliary electrode 310 has the shape of a rectangular block with a recess 311 for accommodating the second bridge segment 32. FIG. 5B is a schematic top view of the lamp, showing the four tube segments 11, 12, 13, 14 and the first and third bridge segments 31, 33, and showing that the auxiliary electrode 310 is arranged between the first and second tube segments 11, 12 on the one hand and the third and fourth tube segments 13, 14 on the other hand. Particularly, the auxiliary electrode 310 has a first main surface 312 and a second main surface 313, both parallel to the first and third bridge segments 31, 33 of the lamp, the first main surface 312 being in contact with the first and second tube segments 11, 12 and the second main surface 313 being in contact with the third and fourth tube segments 13, 14.

Figure 5C:
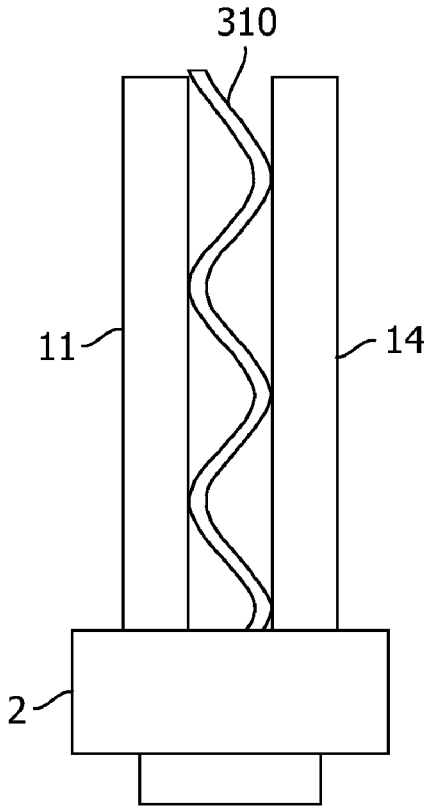

The plate-shaped body of auxiliary electrode 310 may be substantially flat, so that the first and second main surfaces are substantially flat surfaces, being in contact with the four tube segments 11, 12, 13, 14 over substantially their entire length. FIG. 5C is a schematic side view of an alternative embodiment, only showing the first and fourth tube segments 11, 14, and illustrating that the auxiliary electrode 310 may have an undulating cross-section so that the auxiliary electrode 310 touches the tube segments at a discrete number of points along their length. The number of undulations is not critical, but may suitably be between four and twelve, wherein eight undulations is a good example. An advantage of an undulating plate auxiliary electrode is that the undulating auxiliary electrode can be manufactured using less material, and it is easier to obtain a clamp fitting of the auxiliary electrode 310 between the four tube segments 11, 12, 13, 14.

Figure 5D:
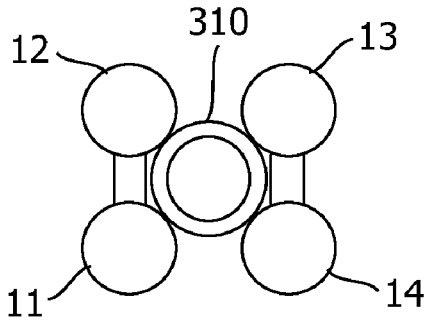

FIG. 5D is a top view, comparable to FIG. 5B, of yet another alternative embodiment, where the auxiliary electrode has a substantially circular outer cross section. The auxiliary electrode 310 in this example may be implemented as a solid rod, but it is also possible that the auxiliary electrode is implemented as a hollow rod, as illustrated. Such a hollow rod electrode will combine the advantages of relatively low weight and flexibility for providing contact with each of the tube segments over their entire length.

Figure 5E:
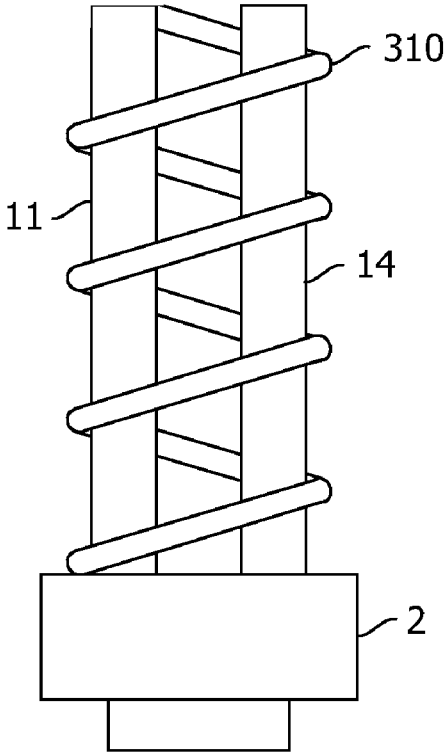
Figure 5F:
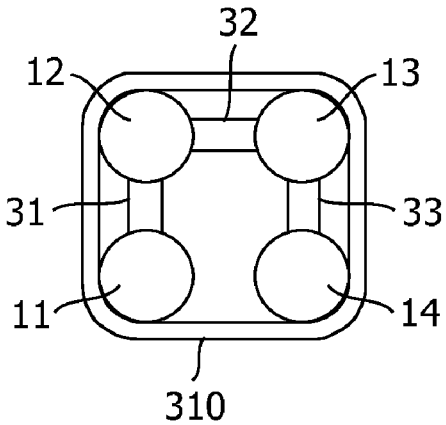

FIGS. 5E and 5F are a schematic side view and a top view, respectively, of an embodiment where the auxiliary electrode is implemented as a wire that is helically wound around the perimeter of the tube segments 11, 12, 13, 14.

Figure 6A:
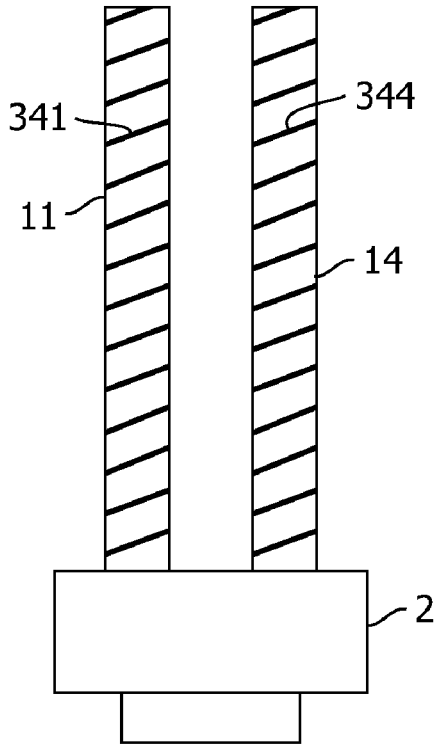
FIGS. 6A-6B illustrate several shapes of an external electrode according to the present invention.
Figure 6B:
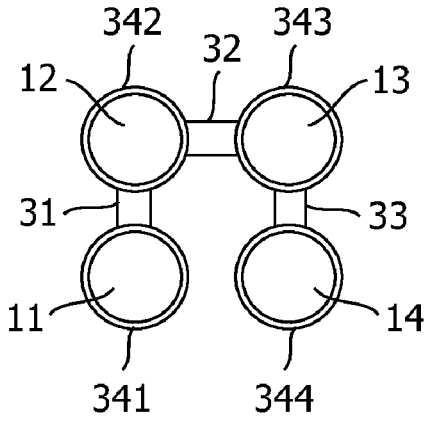

In the above-described embodiments, the auxiliary electrode always comprises one electrode body that contacts all tube segments. In an alternative embodiment, the auxiliary electrode comprises a plurality of electrode bodies electrically connected to each other, wherein each electrode body contacts a respective tube segment. FIGS. 6A and 6B are a schematic side view and a top view, respectively, comparable to FIGS. 5A and 5F, respectively, where the auxiliary electrode 310 comprises four electrode wires 341, 342, 343, 344, each helically wound around a corresponding tube segment 11, 12, 13, 14. The four wires 341, 342, 343, 344 are electrically connected to each other, but this is not shown here for the sake of convenience. In another embodiment, the auxiliary electrode bodies may, for each tube segment, comprise at least one wire extending axially along such a tube segment.

Figure 7:
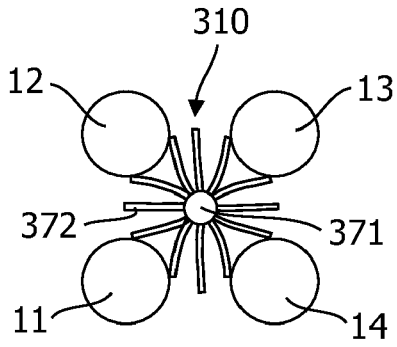
FIG. 7 is a schematic top view of another embodiment of an external electrode according to the present invention.

FIG. 7 is a schematic top view of another possible embodiment of the auxiliary electrode 310, implemented as a cylindrical brush. A central longitudinal body 371 is provided with a plurality of flexible transverse arms 372, distributed along the length of the longitudinal body 371 and around the parameter of the longitudinal body 371. Like the hollow rod illustrated in FIG. 5D, the brush embodiment of FIG. 7 can easily be arranged at a location centrally between the tube segments 11, 12, 13, 14, in which case the transverse arms 372 extend from the longitudinal body 371 to the respective tube segments 11, 12, 13, 14.

Figure 8:
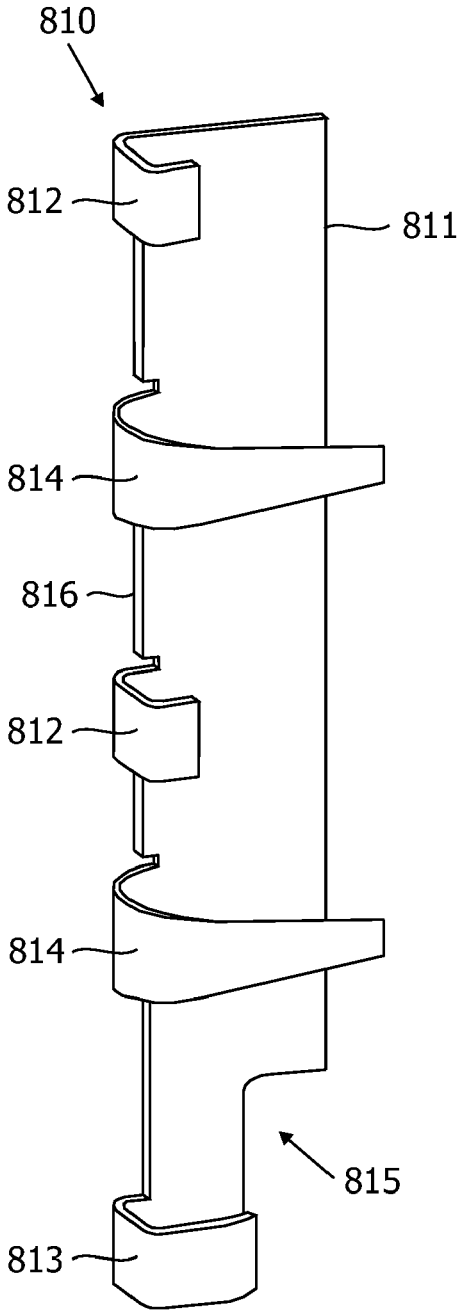
FIG. 8 is a schematic perspective view of another embodiment of an external electrode according to the present invention.

In all of the embodiments discussed above, the external electrode is in mechanical contact with all four tube segments. Consequently, the external electrode may exert transverse forces on the tube segments, depending on the exact design and dimensioning of the external electrode, and it may be that such forces are undesirable in view of the risk of breakage of tube segments. FIG. 8 is a schematic perspective view of a preferred embodiment of the auxiliary electrode, here indicated by reference numeral 810, in which such a risk is avoided by avoiding mechanical contact with all four tube segments while at the same time maintaining a firm fixation of the auxiliary electrode with respect to the tube segments.

The auxiliary electrode 810 is formed as a planar plate 811, which is intended to be placed just like the plate-shaped embodiment of FIG. 3, i.e. extending between the first and second tube segments 11, 12 on the one side and the third and fourth tube segments 13, 14 on the other side. The plate 811 has a recess 815 for accommodating the second bridge segment 32. The plate 811 has a thickness slightly smaller than the distance between the first and fourth tube segments 11, 14, so that it cannot be clamped between the tube segments. For firm fixation of the auxiliary electrode 810 to the lamp, the plate 811 is provided with lips 812, 813, 814 extending from a front vertical edge 816 opposite the recess 815, which lips are bent back, all in the same direction, substantially according to a radius corresponding to the radius of a tube segment. The lips may all have the same size. In the embodiment shown, the electrode 810 has two smaller U-shaped lips 812 just fitting around a tube segment over about 180°, and further has two larger J-shaped lips 814 extending to an adjacent tube segment. The lowermost lip 813 of the electrode 810 has an end portion bent towards the plate 811 so that this lip 813 fits around the tube segment over more than 180°.

The auxiliary electrode 810 is placed with its lips around either the first or the fourth tube segment, i.e. a tube segment containing an electrode, the choice depending on the direction into which the lips are bent; in the embodiment shown, this would be the fourth tube segment 14. The lips firmly clamp the auxiliary electrode 810 to this tube segment 14, with the plate 811 being in mechanical contact with this tube segment 14 over substantially its entire height. The plate 811 is further in mechanical contact with the neighboring tube segment 13, held in place by the J-shaped lips 814, yet without hardly any transverse force. Although the plate 811 is not in mechanical contact with the two opposite tube segments 11, 12, its position is at such a short distance from these two tube segments 11, 12 that its advantageous effect described above is reduced only slightly.

Summarizing, the present invention provides a compact gas discharge lamp 301 comprising four (or more) interconnected tube segments 11, 12, 13, 14 provided with an external electrode 310 that extends at least throughout the length of the tube segments and that is in contact with all tube segments. Several embodiments of the external electrode are disclosed. The external electrode is preferably connected to a node C midway between the lamp electrodes, for which purpose a capacitive divider 441, 442 is arranged parallel to the lamp.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, the driver 400 may be located within the base 2, but it is also possible that a luminaire has a receptacle for the base 2 and that this receptacle is provided with the driver 400.

Further, for the sake of completeness it is noted that the auxiliary electrode will be provided with an electrical connector attached to it or formed as an integral part, but this is not illustrated for the sake of simplicity.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such (a) functional block(s) is performed by individual hardware components, but it is also possible that one or more of these functional blocks are implemented in software, so that the function of such (a) functional block(s) is performed by one or more program lines of a computer program or a programmable device such as a microprocessor, microcontroller, digital signal processor, etc.

The invention claimed is:

1. Dimmable light generating device, comprising:

a tubular gas discharge lamp (301), comprising a plurality of tube segments (11, 12, 13, 14) arranged substantially parallel to each other, the tube segments having an axial length, the number of tube segments being an even integer, each tube segment having an interior space, the tube segments being coupled to each other by transverse tube segments (31, 32, 33) so that the interior space of one tube segment always communicates with the interior space of at least one other tube segment;

a first lamp electrode filament (21) arranged within the interior space of a first tube segment (11) at a proximal end of said first tube segment, with first electrode terminals extending to outside of said first tube segment;

a second lamp electrode filament (22) arranged within the interior space of a last tube segment (14) at a proximal end of said last tube segment, with second electrode terminals extending to outside of said last tube segment;

the device further comprising an electrically conductive external auxiliary electrode (310; 810), which auxiliary electrode is arranged outside the tube segments (11, 12, 13, 14) and has an axial extent corresponding to the axial length of the tube segments, and which auxiliary electrode is capacitively coupled to all tube segments and is coupled to a reference voltage level.

2. Device according to claim 1, wherein the auxiliary electrode comprises one electrode body contacting all tube segments.

3. Device according to claim 2, wherein the auxiliary electrode is implemented as a wire helically wound around the perimeter of the tube segments.

4. Device according to claim 2, wherein the auxiliary electrode is implemented as a cylindrical, possibly hollow rod arranged parallel to the tube segments at a location centrally between said tube segments.

5. Device according to claim 2, wherein the auxiliary electrode is implemented as a cylindrical brush comprising a central longitudinal body arranged parallel to the tube segments at a location centrally between said tube segments, the body being provided with a plurality of transverse arms distributed along the length of the longitudinal body and extending from the longitudinal body to the respective tube segments.

6. Device according to claim 2, wherein the number of tube segments is equal to four, and wherein the auxiliary electrode is implemented as a plate having a first main surface in contact with the first and second tube segments and having an opposite second main surface in contact with the third and fourth tube segments.

7. Device according to claim 6, wherein the plate is a substantially flat plate.

8. Device according to claim 6, wherein the plate has an undulating cross-section.

9. Device according to claim 8, wherein the plate has in the order of 8 undulations.

10. Device according to claim 1, wherein the auxiliary electrode comprises a plurality of electrode bodies contacting respective tube segments, the electrode bodies being electrically connected to each other.

11. Device according to claim 10, wherein an electrode body is implemented as a wire helically wound around a corresponding tube segment.

12. Device according to claim 10, wherein an electrode body comprises at least one wire extending axially along a corresponding tube segment.

13. Device according to claim 1, wherein the auxiliary electrode is electrically connected to one of said electrode terminals.

14. Device according to claim 1, wherein the auxiliary electrode is electrically connected to mass.

15. Device according to claim 1, wherein the number of tube segments is equal to four, and wherein the auxiliary electrode (810) is implemented as a substantially flat plate (811) having a first main surface in contact with two tube segments and having an opposite second main surface located at a short distance from the opposite tube segments.

16. Device according to claim 15, wherein the plate (811) is provided with a plurality of lips (812, 813, 814) extending from a front vertical edge (816), which lips are bent back, all in the same direction, substantially according to a radius corresponding to the radius of a tube segment.

17. Device according to claim 16, wherein the electrode (810) has at least one smaller U-shaped lip (812) just fitting around a tube segment over about 180°.

18. Device according to claim 16, wherein the electrode (810) has at least one larger J-shaped lip (814) extending to an adjacent tube segment.

19. Device according to claim 16, wherein the electrode (810) has at least one lip (813) of which an end portion is bent towards the plate (811) so that this lip (813) fits around the tube segment over more than 180°.

20. Device according to claim 1, further comprising:

a lamp driver (400) comprising a main power source (110) for generating high-frequency pulse-width variable lamp current, a first electrode-heating power source (151) for supplying the first lamp electrode filament (21) with electrode heating current, and a second electrode-heating power source (152) for supplying the second lamp electrode filament (22) with electrode heating current;

wherein the main power source has a first main output terminal (121) connected to a first one of said first electrode terminals and a second main output terminal (122) connected to a first one of said second electrode terminals;

wherein the first electrode-heating power source (151) has output terminals connected to said first electrode terminals; and wherein the second electrode-heating power source (152) has output terminals connected to said second electrode terminals.

21. Device according to claim 20, wherein the lamp driver comprises a capacitive voltage divider comprising a series arrangement of two capacitors (441, 442) arranged between said first one of said first electrode terminals and said first one of said second electrode terminals, and wherein the auxiliary electrode is electrically connected to a node (C) between said two capacitors.

* * * * *